US007159563B1

(12) United States Patent
Garrick

(10) Patent No.: US 7,159,563 B1
(45) Date of Patent: Jan. 9, 2007

(54) PIEZO ELECTRONIC THROTTLE CONTROL ACTUATOR

(75) Inventor: Robert D. Garrick, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/262,022

(22) Filed: Oct. 28, 2005

(51) Int. Cl.
*F02D 9/02* (2006.01)
*F02D 11/10* (2006.01)

(52) U.S. Cl. ..... 123/399; 123/337

(58) Field of Classification Search ..... 123/337, 123/361, 396, 399; 251/129.06
See application file for complete search history.

(56) References Cited

U.S. PATENT DOCUMENTS 4,601,271 A * 7/1986 Ejiri et al. ..... 123/361
4,909,212 A * 3/1990 Minowa et al. ..... 123/337
4,915,074 A * 4/1990 Arai ..... 123/399

FOREIGN PATENT DOCUMENTS

| | | |
|---|---|---|
| DE | 4224424 | * 12/1993 |
| JP | 1-203620 | * 8/1989 |
| JP | 3-50345 | * 3/1991 |
| JP | 8-296757 | * 11/1996 |

* cited by examiner

*Primary Examiner*—T. M. Argenbright
(74) *Attorney, Agent, or Firm*—Paul L. Marshall

(57) ABSTRACT

An electronic throttle control having a piezo actuator that, when energized, will deliver a force to the throttle gear sufficient to free it from a stuck condition.

19 Claims, 3 Drawing Sheets

PIEZO ELECTRONIC THROTTLE CONTROL ACTUATOR

TECHNICAL FIELD

The present invention relates to throttle controls and, more particularly, to a throttle control including a piezo electronic actuator for moving the throttle plate from the fully closed position, especially if the plate is stuck in the closed position due to ice or coke formation in the throttle bore.

BACKGROUND OF THE INVENTION

An electronic throttle control system (ETC) for controlling the amount of air to an engine is well known. The throttle valve plate of the throttle body pivots in response to signals received from the engine control unit (ECU) and thereby acts to regulate the amount of air delivered to the intake manifold. Throttle position and engine load sensors help the ECU maintain the correct throttle position over the range of expected engine torque loads.

Prior art throttle plates are designed to default to a "home" position where the plate is approximately 10–20 degrees to the axis of the throttle bore in which it is pivotally attached. Thus, when an engine is in the engine-off condition, prior art throttle plates are designed to default to the home position which is a slightly open position (e.g., by about 10–20 degrees depending on the particular application) when in the engine-off condition or upon receiving an ETC fault signal. Should the ETC malfunction, some air must be able to reach the intake manifold to allow the car a "limp home" condition for needed repairs. Thus, the prior art typically provides an ETC throttle system with a throttle plate that defaults to a slightly open position in engine-off and ETC failure conditions. However, one problem that has been encountered to this throttle home default position is the throttle plate becoming stuck in the home position due to winter-time ice and/or engine carbon based build up (commonly referred to as engine coke) in this area. In response to this problem, prior art throttles have been designed with a DC brush motor and two stage spur gear train to produce the torque necessary to break the throttle free from ice and/or coke formation. This, however, requires a relatively large amount of space in the throttle housing which is inefficient and costly. There therefore exists a need for an ETC throttle body that gives the engine enough air for a limp home condition yet also provides relatively small, inexpensive components capable of delivering a large amount of torque to free the throttle plate from a stuck position.

SUMMARY OF THE INVENTION

The present invention addresses the above need by providing a piezo actuator in proximity to the throttle plate gear. Upon receiving a signal that the is throttle plate is stuck, the piezo actuator is energized, thereby expanding and delivering a high force to the gear to free it from the stuck position. In a preferred embodiment, the piezo actuator comprises an extending type piezo actuator in a cavity located adjacent the main throttle gear. The first end of a lever arm is placed adjacent the piezo in the cavity and extends outwardly therefrom. The second end of the lever arm is positioned between the plate adjusting screw and the main throttle plate gear.

Upon receiving a signal that the throttle plate is stuck, the piezo is energized and thereby extends to deliver a force against the first end of the lever arm. A fulcrum point is provided along the lever arm against which it pivots in response to the force received at the first end thereof from the piezo. The lever arm thus pivots to move the second end thereof against the main throttle gear. The piezo force (a relatively small displacement with a large force) is thus transferred through the arm to the gear which causes the gear to move, thereby freeing the stuck throttle plate.

BRIEF DESCRIPTION OF THE DRAWINGS

The present invention will now be described, by way of example, with reference to the accompanying drawings, in which.

DESCRIPTION OF THE PREFERRED EMBODIMENT

Figure 1:
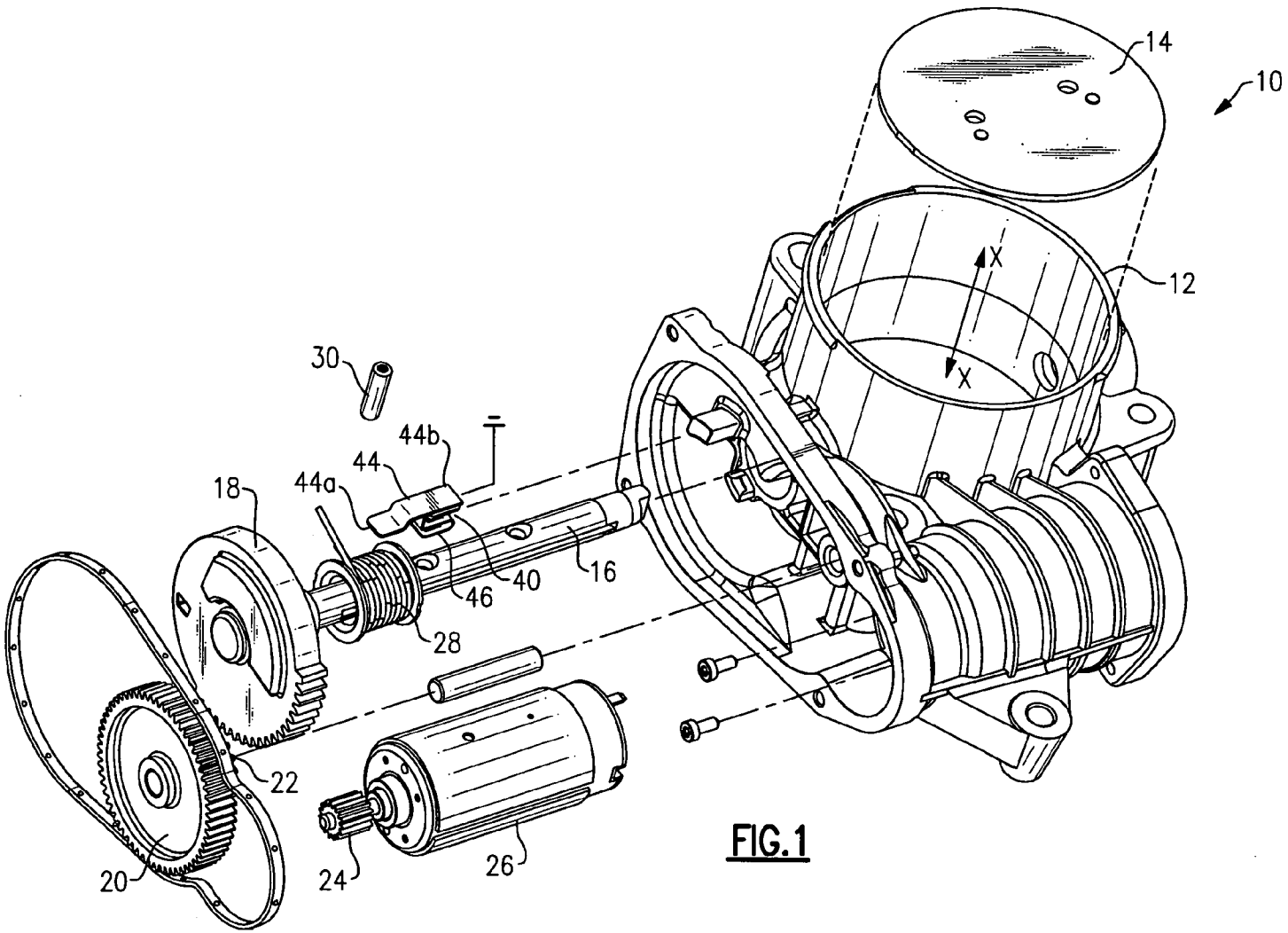
FIG. 1 is an exploded perspective view of an electronic throttle control (ETC) body in accordance with an embodiment of the invention.
Figure 2:
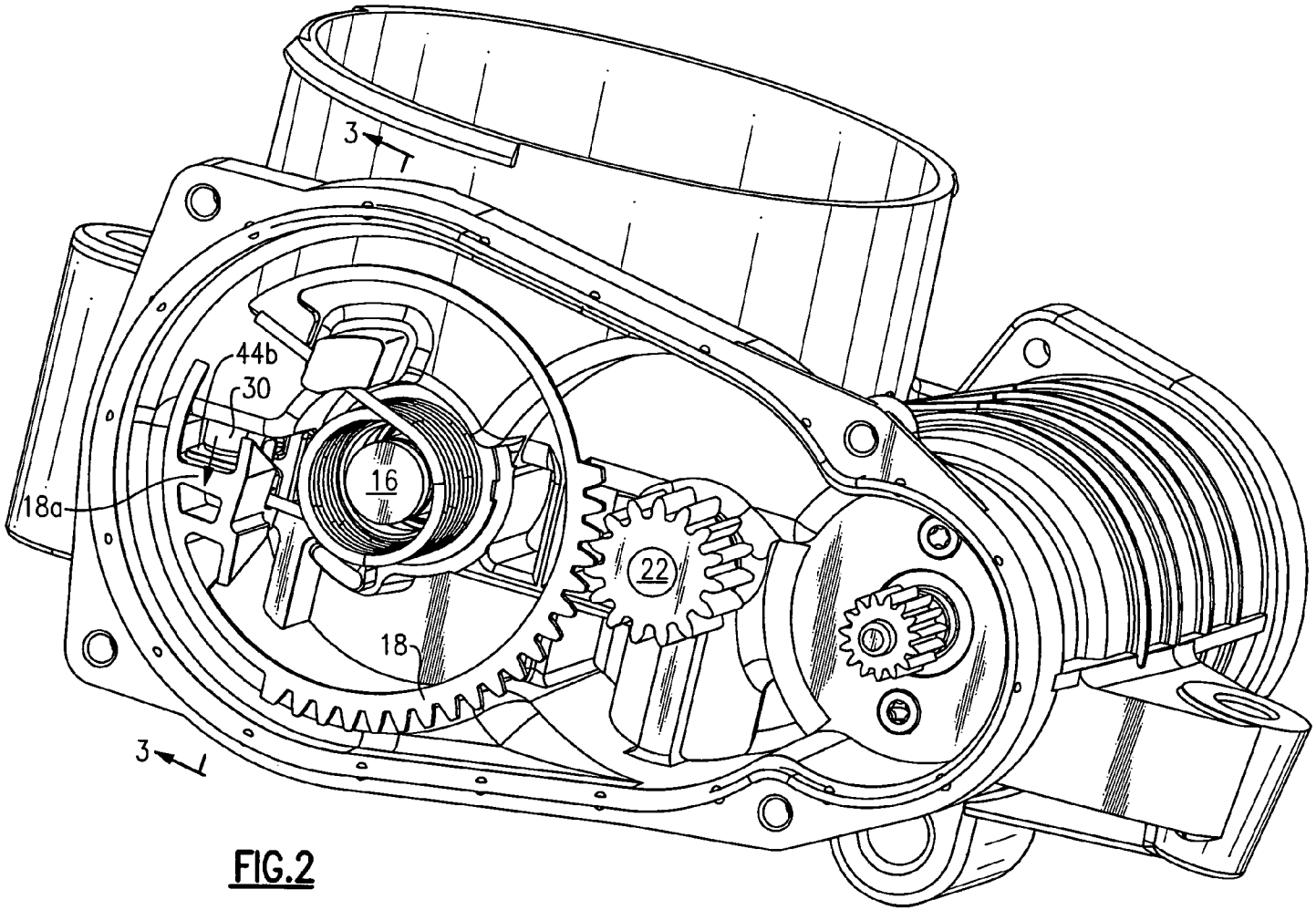
FIG. 2 is a an assembled perspective view of the ETC body of FIG. 1 (gear 20 removed for clarity)
Figure 3:
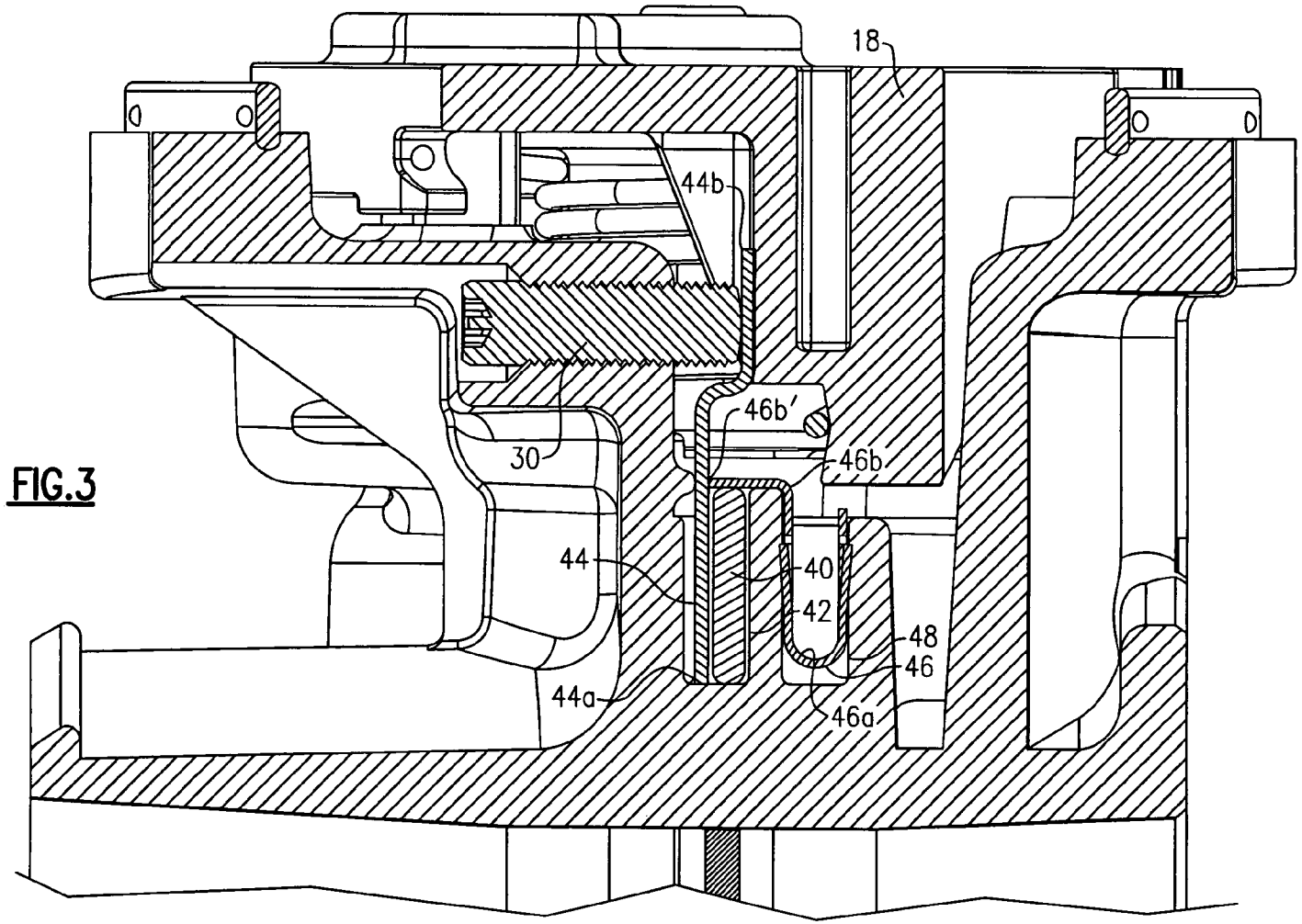
FIG. 3 is a cross-sectional view as taken generally along the line 3—3 of FIG. 2.

Referring to FIGS. 1–3, an electronic throttle control body 10 (hereinafter "ETC") is provided including a main throttle bore 12 having a longitudinal bore axis X—X and wherethrough air flows to the intake manifold of an engine (not shown). The air then mixes with fuel to power the engine in a well known manner. A throttle plate 14 is pivotally secured in main throttle bore 12 and may be pivoted between the closed and open positions therein to control the amount of air reaching the intake manifold. The movement of the throttle plate 14 is controlled via a shaft 16 connected to a main throttle gear 18 which itself is driven by planetary gears 20, 22 and spur gear 24. Spur gear 24 is driven by a motor 26 (FIG. 2) which connects to the engine control unit (hereinafter "ECU"—not shown) which sends signals to the motor 26 in response to the sensed throttle plate position and engine load conditions. Main throttle gear 18 is biased by a spring 28 in the throttle-closed position, the exact rotational angle of which may be precisely set through adjustment of adjusting screw 30 against gear 18.

As stated above, a relatively large amount of force is required to initially break free a throttle plate that is stuck in the closed position by ice or coke formation. Rather than provide a larger, more powerful motor and/or gear train to provide the needed torque to the gear 18, the present invention provides a piezo electronic actuator that delivers high torque with little displacement and hence small space requirements. Once the gear 18 and throttle plate 14 are freed from the stuck position by the piezo actuator, the amount of torque required to further pivot the throttle plate is nominal and the piezo is not needed.

Referring to FIGS. 1 and 3, an extending type piezo unit 40 is provided in a cavity 42 in proximity to the main throttle gear 18. A lever arm 44 having first and second ends 44*a*, 44*b*, respectively, is positioned with first end 44*a* thereof positioned alongside piezo unit 40 in common cavity 42. The second end 44*b* is positioned between adjusting screw 30 and gear 18. The lever arm 44 may be linear or non-linear (as shown) depending on the specific ETC design employed. A fulcrum is provided in the form of a clip 46 having a U-shaped portion 46*a* positioned in a cavity 48 and including an extension portion 46*b* which extends over piezo 40, terminating at arm 44. The terminal end 46*b*' of the extension portion 46*b* forms the fulcrum against which arm 44 may pivot. Thus, upon piezo 40 being energized and applying a force against arm first end 44*a*, arm 44 will pivot about terminal end 46*b*', causing arm second end 46*b* to move in the opposite direction as first end 44 and against gear 18. In this regard, as seen in FIG. 2, gear 18 includes a radially extending bearing surface 18*a* against which arm 44*b* strikes (in the direction of the arrow) to force the gear 18 out of the stuck position. The force of the piezo is selected to be adequate for freeing a stuck throttle plate. In one preferred embodiment, piezo actuator 40 is selected to deliver a force of approximately 2 Nm against gear 18.

As additional advantage of positioning arm end 44*b* between gear bearing surface 18*a* and adjustment screw 30 is that it provides a cushioning effect for the bearing surface 18*a* when gear 18 returns to its home position. As such, wear of the teeth of gear 18 is reduced.

While the invention has been described by reference to various specific embodiments, it should be understood that numerous changes may be made within the spirit and scope of the inventive concepts described. For example, the exact type and placement of the piezo actuator 40 may vary as required. Furthermore, the configuration and placement of clip 46 may likewise vary as required. Additionally, it is envisioned that clip 46 may be omitted and replaced by a fulcrum that is integral to the throttle body. The invention provides a piezo actuator that, when energized, will deliver a force to the throttle gear sufficient to free it from a stuck condition. Any auxiliary components needed to transfer the force from the piezo to the gear (e.g., a fulcrum and arm) are selected according to the particular ETC design being employed.

Accordingly, it is intended that the invention not be limited to the described embodiments, but will have full scope defined by the language of the following claims.

What is claimed is:

1. An electronic throttle control operable through signals received by an engine control unit, said electronic throttle control comprising:

a) a throttle body having a main throttle bore wherein a throttle plate is pivotally secured;

b) a gear train having a main throttle gear connected to pivot said throttle plate in response to signals received from the engine control unit; and c) a piezo actuator positioned and operable to move said main throttle gear upon said piezo actuator being energized in response to a signal received from the engine control unit.

2. The electronic throttle control of claim 1, and further comprising a lever arm having first and second ends, said first end adjacent said piezo actuator and said second end adjacent said main throttle gear whereby said lever arm pivots and strikes said main throttle gear with said second end thereof in response to energizing said piezo actuator.

3. The electronic throttle control of claim 2 and further comprising a clip having an edge forming a fulcrum against which said lever arm pivots.

4. The electronic throttle control of claim 2 wherein said lever arm is non-linear.

5. The electronic throttle control of claim 2 wherein said piezo actuator and said lever arm first end are positioned in a common cavity.

6. The electronic throttle control of claim 5 and further comprising a clip having an edge forming a fulcrum against which said lever arm pivots, at least a portion of said clip being positioned in a second cavity located adjacent said common cavity.

7. The electronic throttle control of claim 1 and further comprising an adjusting screw operable to adjust the pivot position of said throttle plate.

8. The electronic throttle control of claim 7 wherein said lever arm second end is positioned between said main throttle gear and said adjusting screw.

9. The electronic throttle control of claim 2 wherein said main throttle gear includes a radially extending bearing surface against which said lever arm second end strikes upon energizing said piezo actuator.

10. A method of providing a force to a throttle gear connected to a throttle plate comprising the steps of providing an engine control unit, and sending a signal from said engine control nit to energize a piezo actuator operable to deliver said force to said gear when said engine control unit determines that said throttle plate is stuck.

11. The method of claim 10 wherein said piezo actuator is of the extending type.

12. The method of claim 11, and further comprising the step of providing a lever arm having first and second ends, said first end adjacent said piezo actuator and said second end adjacent said main throttle gear whereby said lever arm pivots and strikes said main throttle gear with said second end thereof in response to energizing said piezo actuator.

13. The method of claim 12 and further comprising the step of providing a clip having an edge forming a fulcrum against which said lever arm pivots.

14. The method of claim 12 wherein said lever arm is non-linear.

15. The method of claim 12 and further comprising the step of positioning said piezo actuator and said lever arm first end in a common cavity.

16. The method of claim 15 and further comprising the step of providing a clip having an edge forming a fulcrum against which said lever arm pivots, at least a portion of said clip being positioned in a second cavity located adjacent said common cavity.

17. The method of claim 12 and further comprising the step of providing an adjusting screw operable to adjust the pivot position of said throttle plate.

18. The method of claim 17 and further comprising the step of positioning said lever arm second end between said main throttle gear and said adjusting screw.

19. The method of claim 18 and further comprising the step of providing said main throttle gear with a radially extending bearing surface against which said lever arm second end strikes upon energizing said piezo actuator.

* * * * *